US006619249B2

(12) United States Patent
Sakuragi et al.

(10) Patent No.: US 6,619,249 B2
(45) Date of Patent: Sep. 16, 2003

(54) HYDRAULIC CONTROL SYSTEM FOR AN INTERNAL COMBUSTION ENGINE

(75) Inventors: Shigeru Sakuragi, Tokyo (JP); Masaki Toriumi, Yokohama (JP); Kazuto Tomogane, Yokohama (JP); Shigeki Shindou, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/050,935

(22) Filed: Jan. 22, 2002

(65) Prior Publication Data

US 2002/0104496 A1 Aug. 8, 2002

(30) Foreign Application Priority Data

Jan. 22, 2001 (JP) ..... 2001-012577

(51) Int. Cl.[7] ..... F01L 1/34

(52) U.S. Cl. ..... 123/90.16; 123/90.17; 123/198 F; 123/90.15

(58) Field of Search ..... 123/90.12, 90.15, 123/90.16, 90.17, 198 F, 406.23, 481; 91/520, 440

(56) References Cited

U.S. PATENT DOCUMENTS

| | | | | |
|---|---|---|---|---|
| 3,303,753 A | * | 2/1967 | McCay, Jr. | 91/520 |
| 4,622,886 A | * | 11/1986 | Imada et al. | 91/520 |
| 4,977,928 A | * | 12/1990 | Smith et al. | 137/596 |
| 5,335,499 A | * | 8/1994 | Thompson et al. | 60/546 |
| 5,460,129 A | * | 10/1995 | Miller et al. | 123/90.15 |

FOREIGN PATENT DOCUMENTS

| | | |
|---|---|---|
| JP | 5-248217 | 9/1993 |
| JP | 2000-73797 | 3/2000 |
| JP | 2000-145487 | 5/2000 |
| JP | 2000-234533 | 8/2000 |

* cited by examiner

*Primary Examiner*—Thomas Denion
*Assistant Examiner*—Jaime Corrigan
(74) *Attorney, Agent, or Firm*—Foley & Lardner

(57) ABSTRACT

A hydraulic control system for an internal combustion engine is provided which comprises a first hydraulic operating mechanism and a second hydraulic operating mechanism, the first hydraulic operating mechanism and the second hydraulic operating mechanism being operated independently by oil pressure of a common oil press source, and a circulation line that supplies pressure oil discharged from the first hydraulic operating mechanism to the second hydraulic operating mechanism.

18 Claims, 5 Drawing Sheets

RETARD
MOVEMENT OF PISTON
FLOW OF OIL

ADVANCE

MAINTENANCE OF STATUS QUO
INTAKE VALVE
EXHAUST VALVE
TDC
16
16a
21
22
23
24
25
26
27
41
43
44
46
48

UPON FULL CYLINDER OPERATION

UPON PART CYLINDER OPERATION

HYDRAULIC CONTROL SYSTEM FOR AN INTERNAL COMBUSTION ENGINE

BACKGROUND OF THE INVENTION

The present invention relates to a hydraulic control system for an internal combustion engine, which has two hydraulic operating mechanisms operated independently by oil pressure of a common oil pressure source. The present invention further relates to a hydraulic control system for an internal combustion engine, which has two variable valve timing control mechanisms capable of varying lift characteristics of at least one of an intake valve and an exhaust valve.

In the field of internal combustion engines, it is a common practice to actuate various kinds of hydraulic operating mechanisms by using an oil pump for circulation of lubrication oil as an oil pressure source. Examples of such hydraulic operating mechanism are a variable valve timing control mechanism for varying the opening and closing timings and the lift of the intake and exhaust valves in accordance with the operating condition of the engine and a variable compression ratio control mechanism for varying the piston stroke of each cylinder and thereby varying the compression ratio in accordance with the operation condition of the engine.

An example of a hydraulic variable valve timing control mechanism is disclosed in Japanese Patent Provisional Publication No. 5-248217. This variable valve timing control mechanism is capable of varying the opening and closing timings of the intake and exhaust valves in two steps by switching from one of a low-speed rocker arm and a high-speed rocker arm to another. Other variable valve timing control mechanisms are a variable phase control mechanism for varying the operation angle phase (i.e., maxim lift phase) of the intake and exhaust valves, an operation angle varying mechanism for varying the operation angles and valve lifts of the intake and exhaust valves and a valve stop mechanism for temporarily stopping the intake and exhaust valves of some of the cylinders.

SUMMARY OF THE INVENTION

In this connection, in case two hydraulic operating mechanisms which are operated independently by oil pressure of a common oil pressure source e used in an internal combustion engine, there is a possibility of causing the following problems. Namely, In case the operating conditions of both of the hydraulic operating mechanisms are changed simultaneously, particularly at a low-speed engine operating condition where the oil pressure produced by the oil pump is low, there is a possibility that the hydraulic operating mechanisms become poor in responsiveness due to a lack of the oil pressure supplied thereto. To prevent such deterioration of the responsiveness, it is considered to use an oil pump, accumulator or the like for the hydraulic operating mechanisms' exclusive use. However, in this instance, a hydraulic circuit of the hydraulic control system becomes complicated in structure, thus causing a possibility of increasing the weight and the cost.

Particularly, in case the two hydraulic operating mechanisms are variable valve timing control mechanisms for varying the lift characteristics of the intake and exhaust valves, it is highly necessitated to change the operating conditions of the variable valve timing control mechanisms at the same timing so as to attain the required lifts which vary largely in accordance with the operating conditions of the engine at idling or at full-throttle operation.

For example, in case a variable phase control mechanism for varying the operation angle phase of an intake valve and a valve stop mechanism for temporarily stopping the intake and exhaust valves of some of the cylinders are used, it is desirable, when the valve stop mechanism is operated to stop the intake and exhaust valves of some of the cylinders, to advance the operation angle phase of the intake valve by the variable phase control mechanism so that a predetermined torque can be attained by the remaining cylinders. In this instance, the delay of the responsiveness of the valve stop mechanism becomes a particularly large problem. Namely, in the cylinders where the intake and exhaust valves are stopped, it is necessitated to inhibit injection of fuel. If there is a difference between the period during which the intake and exhaust valves are actually stopped and the period during which injection of fuel is actually inhibited, it is possible that fuel is injected during the time of the valves being stopped. This is particularly not desirable.

It is accordingly an object of the present invention to provide a hydraulic control system for an internal combustion engine, which has two hydraulic operating mechanisms operated independently by oil pressure of a common oil pressure source and which is simple in structure and has an improved responsiveness.

To accomplish the above object, there is provided according to an aspect of the present invention a hydraulic control system for an internal combustion engine comprising a first hydraulic operating mechanism, a second hydraulic operating mechanism, the first hydraulic operating mechanism and the second hydraulic operating mechanism being operated independently by oil pressure of a common oil pressure source, and a circulation line that supplies pressure oil discharged from the first hydraulic operating mechanism to the second hydraulic operating mechanism.

According to another aspect of the present invention, there is provided a hydraulic control system for an internal combustion engine comprising an oil pressure source, an oil sump, a first hydraulic operating mechanism, a second hydraulic operating mechanism, a first hydraulic control valve for selectively communicating the first hydraulic operating mechanism with one of the oil pressure source and the oil sump thereby controlling an operation of the first hydraulic operating mechanism, a second hydraulic control valve for selectively communicating the second hydraulic operating mechanism with one of the oil pressure source and the oil sump, a control line fluidly connecting between the second hydraulic control valve and the second hydraulic operating mechanism for conducting pressure oil supplied to and discharged from the second hydraulic operating mechanism, and a circulation line connecting between the first hydraulic control valve and the control line for supplying pressure oil discharged from the first hydraulic operating mechanism to the second hydraulic operating mechanism.

According to a further aspect of the present invention, there is provided a hydraulic control system for an internal combustion engine comprising a phase control mechanism for varying a phase of an intake valve, a valve stop mechanism for temporarily stopping intake and exhaust valves of some of cylinders, the phase control mechanism and the valve stop mechanism being operated by oil pressure of a common oil pressure source, and means for supplying pressure oil discharged from the phase control mechanism to the valve stop mechanism in addition to pressure oil supplied from the oil pressure source to the valve stop mechanism when the phase of the intake valve is advanced by the phase control mechanism and the intake and exhaust valves of some of the cylinders are stopped by the valve stop mechanism.

DESCRIPTION OF THE PREFERRED EMBODIMENT

Figure 1:
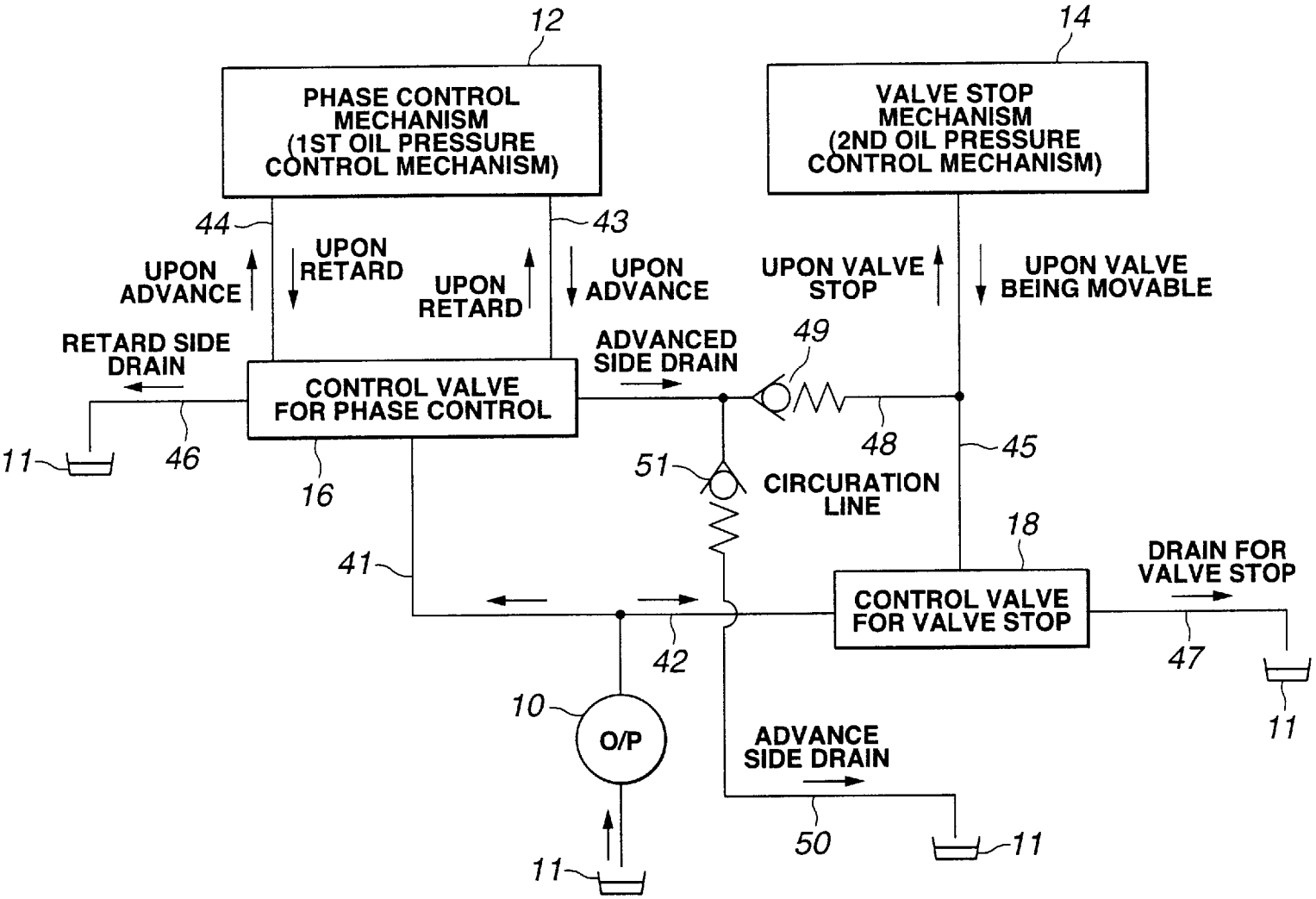
FIG. 1 is a hydraulic control system for an internal combustion engine according to an embodiment of the present invention.

Referring first to FIG. 1, a hydraulic control system for an internal combustion engine includes first hydraulic operating mechanism 12 and second hydraulic operating mechanism 14 that are fluidly connected to oil pump 10 serving as a anon oil pressure source. In this embodiment, hydraulic operating mechanism 12 and 14 are embodied in valuable valve timing control mechanisms capable of varying lift characteristics of at least one of an intake valve and an exhaust valve of each cylinder. More specifically, hydraulic operating mechanisms 12 and 14 are embodied in a variable phase control mechanism for continuously varying the phase of an intake valve and a valve stop mechanism for temporarily stopping the intake and exhaust valves of some (e.g., a half) of the cylinders, respectively.

Further, the hydraulic control system includes hydraulic control valve 16 for phase control, that controls oil pressure supplied from oil pump 10 to variable phase control mechanism 12, and hydraulic control valve 18 for valve stop, that controls oil pressure supplied from oil pump 10 to valve stop mechanism 14.

Figures 2A, 2B, 2C:
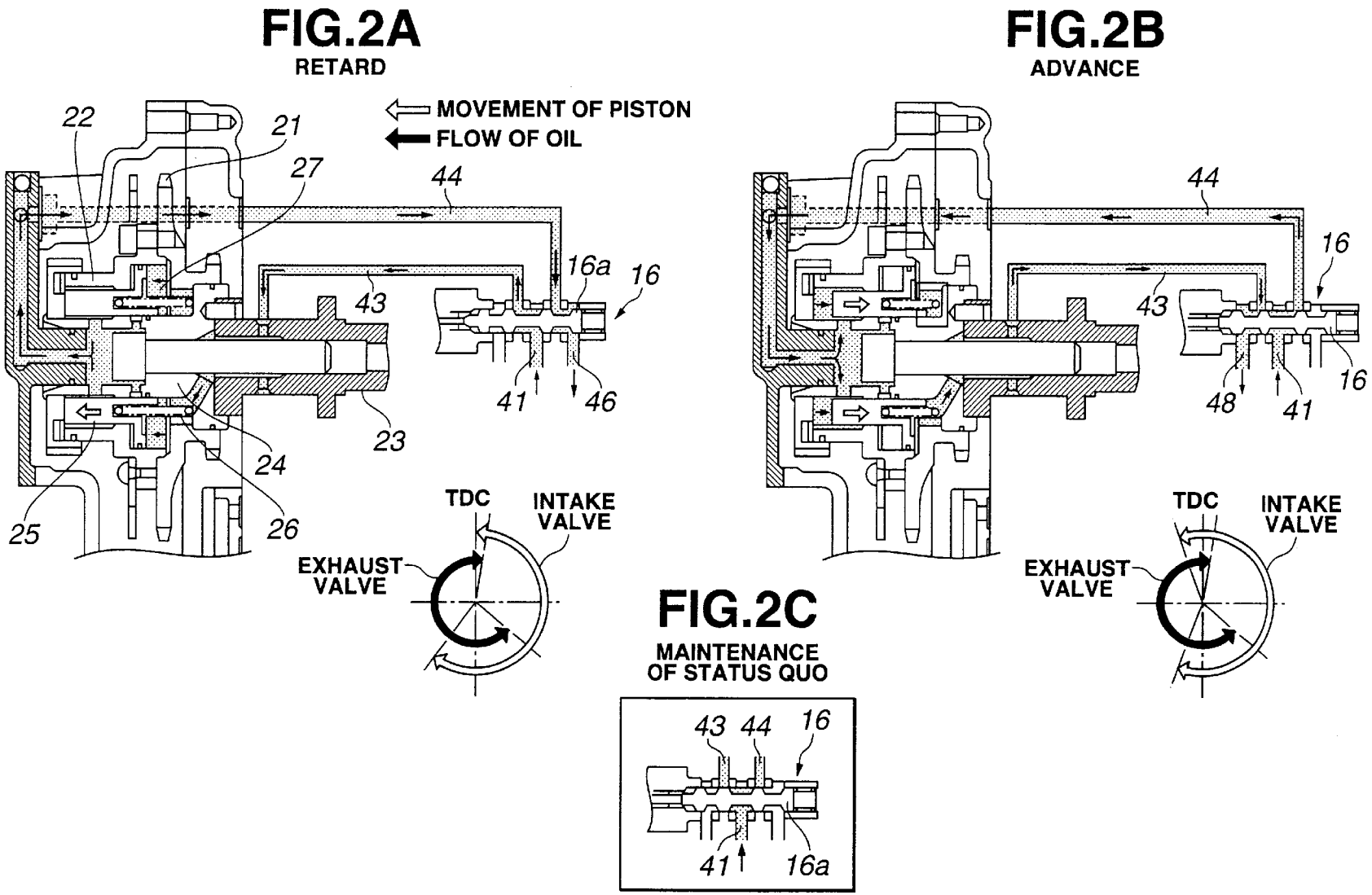
FIGS. 2A to 2C are schematic views for illustrating operations of a variable phase control mechanism and a hydraulic control valve for phase control, which are used in the hydraulic control system of FIG. 1.

Variable phase control mechanism 12 is of the type having been already proposed and described briefly with reference to FIGS. 2A to 2C. Variable phase control mechanism 12 includes outer circumferential side gear potion 22 rotatable together with cam sprocket 21 which is in turn rotatable in timed relation with a crank shaft (not shown), inner circumferential side gear portion 24 disposed concentrically with and inside of cam sprocket 21 and rotatable together with intake cam shaft 23, annular piston 25 meshed with the inner and outer circumferential surfaces of outer circumferential side gear portion 22 and inner circumferential side gear portion 24 by means of splines, and return spring 26 for urging piston 25 toward the retard side.

The opposite ends of piston 25 are associated with retard side oil pressure chamber 27 and advance side oil pressure chamber 28, respectively. By axial movement of piston 25 in response to oil pressures in oil pressure chambers 27 and 28, the phase of intake camshaft 23 relative to cam sprocket 21 is varied thereby varying the phase of the intake valve continuously.

Details of such a phase control mechanism are disclosed in Japanese Patent Provisional Publication Nos. 2000-073797, 2000-145487 and 2000-234533.

Figure 3:
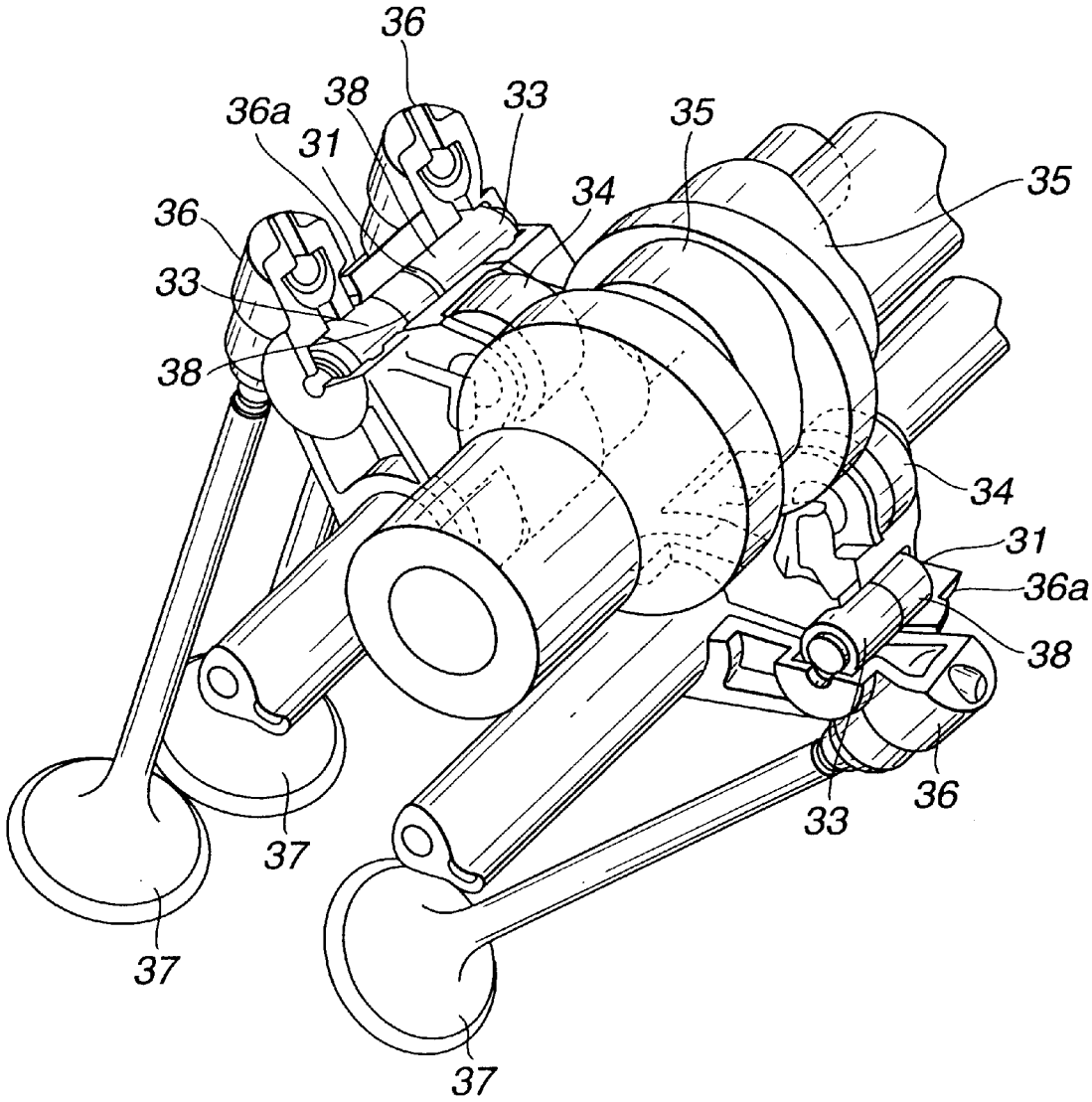
FIG. 3 is a perspective view of a valve stop mechanism used in the hydraulic control system of FIG. 1.

Valve stop mechanism 14 is of the type having been already proposed and described briefly with reference to FIG. 3. When the oil pressure in valve stop oil pressure chamber 31 is low, coupling 33 is urged by the bias of a spring (not shown) disposed inside thereof so as to protrude into a position where it contacts auxiliary rocker arm 36*a* having roller bearing 34. This causes rotational power to be transmitted to the intake and exhaust valves by way of auxiliary rocker arm 36*a*, coupling 33 and rocker arm 36 thereby causing all the cylinders to operate. On the other hand, when a predetermined oil pressure is supplied to valve stop oil pressure chamber 31, piston 38 pushes coupling 33 against the bias of the spring disposed inside coupling 33 and causes coupling 33 to move apart from auxiliary rocker arm 36*a*. This shuts off transmission of power from auxiliary rocker arm 36*a* to coupling 33 thereby performing a part cylinder operation where the intake and exhaust valves of some of the cylinders are stopped. Details of such a valve stop mechanism are disclosed in Pages 56 to 58 of Auto Motor and Sport (German car magazine) No. 15, published on Jul. 14, 1999.

Referring to FIGS. 1 to 4A and 4B, a hydraulic circuit of the hydraulic control system will be described. The hydraulic circuit includes first supply line 41 for supplying oil pressure from oil pumps 10 to hydraulic control valve 16 for phase control, second supply line 42 for supplying oil pressure fan oil pump 10 to hydraulic control valve 18 for valve stop, retard side control line 43 connecting between control valve 16 and retard side oil pressure chamber 27, advance side control line 44 connecting between control valve 16 and advance side oil pressure fiber 28, valve stop control line 45 connecting between control valve 18 and valve stop oil pressure chamber 45, retard side drain line 46 for conducting pressure oil discharged from control valve 16 to oil sump or oil pan 11, and drain line 47 for valve stop for conducting pressure oil discharged from control valve 18 to oil pan 11.

In the embodiment, circulation line 48 is provided which is fluidly connected at one end to retard side oil pressure chamber 27 of phase control mechanism 12 and at another end to valve stop oil pressure chamber 31 of valve stop mechanism 14 so as to supply pressure oil discharged from retard side oil pressure chamber 27 to valve stop oil pressure chamber 31. More specifically, circulation line 48 is connected at one end to control valve 16 so as to communicate with retard side oil pressure chamber 27 of phase control mechanism 12 by way of retard side control line 43 and at another end (downstream side) to valve stop control line 45 so as to communicate therethrough with valve stop oil pressure chamber 31 of valve stop mean 14. Namely, circulation line 48 is constructed so that it can supply pressure oil discharged from retard side oil pressure chamber 27 not through control valve 18 but directly to valve stop oil pressure chamber 31.

In circulation line 48 is disposed check valve 49 for preventing reverse flow of pressure oil from valve stop mechanism 14 to phase control mechanism 12. Further, control valve 51 is disposed in advance side drain line 50 branching off from circulation line 48 at a location upstream of check valve 49 (i.e., on phase control mechanism 12 side of check valve 49) and extending up to oil pan 11. The valve opening pressure of check valve 49 is set at a value lower than that of control valve 51. For example, the valve opening pressure of check valve 49 is set at about 0.1 $kgf/cm^2$ and the valve opening pressure of control valve 51 is set at about 0.3 $kgf/cm^2$.

The operation of the hydraulic control system will now be described.

Phase control mechanism 12 supplies a duty signal to a solenoid (not show) for driving spool 16*a* of control valve 16 thereby feedback controlling the operation angle phase of the intake valve corresponding to the position of piston 25.

More specifically, upon retard, i.e., when the operation angle phase of the intake valve is retarded, spool 16*a* of phase control valve 16 is placed in the position shown in FIG. 2A. This causes the oil pressure from oil pump 10 to be supplied to retard side oil pressure chamber 27 by way of first supply line 41 and retard side control line 43, while causing pressure oil in advance side oil pressure chamber 28 to be discharged through retard side drain line 46 into oil pan 11. As a result, piston 25 is pushed toward the retard side (i.e., to the left-hand side in FIG. 2A). In the meantime, in FIG. 2A are shown the lift characteristics of the intake and exhaust valves that are retarded maximumly.

Upon advance. i.e., when the operation angle phase of the intake valve is advanced, spool 16*a* is placed in the position shown in FIG. 2B. This causes oil pressure to be supplied to advance side oil pressure chamber 28 by way of first supply line 41 and advance side control line 44, while causing pressure oil in retard side oil pressure chamber 27 to be discharged through retard side control line 43 and circulation line 48. As a result, piston 25 is pushed to the advance side (i.e., to the right-hand side in FIG. 2B) . In the meantime, in FIG. 2B are shown the lift characteristics of the intake and exhaust valve that are advanced maximumly.

When the operation angle phase of the intake valve is to be held at any given phase, spool 16*a* is placed in the position shown in FIG. 2C to close both of the ports connected to retard side control line 43 and advance side control line 44. By this, the oil pressure in both oil pressure chambers 27 and 28 is confined therewithin, thus allowing piston 25 to be held at the present position, i.e., making it possible to hold piston 25 at any given position.

Figure 4A:
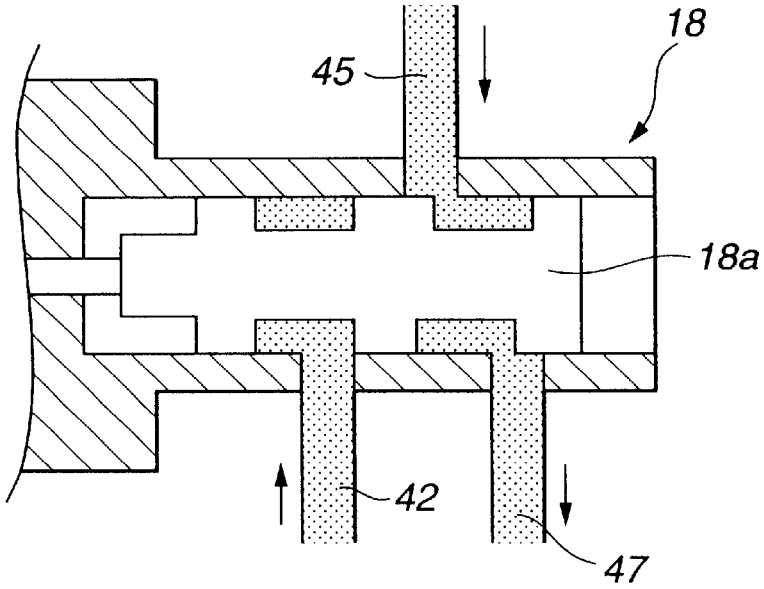
FIGS. 4A and 4B are schematic views for illustrating operations of a hydraulic control valve for valve stop, used in the hydraulic control system of FIG. 1.
Figure 4B:
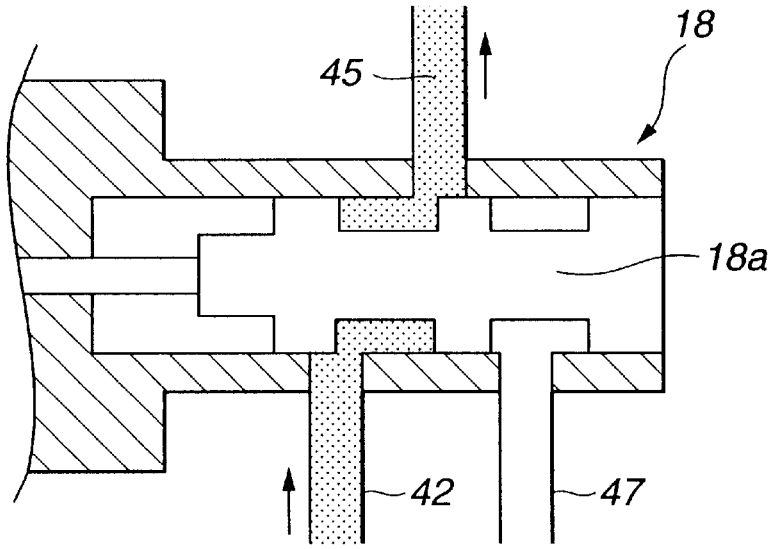

Valve stop mechanism 14 performs switching between full cylinder operation with all cylinders in operation and part cylinder operation with some of the cylinders kept out of operation, by switching the positions of spool 18*a* of control valve 18 according to the operating condition of the engine as shown in FIGS. 4A and 4B. Specifically, at the time of full cylinder operation. spool 18*a* of control valve 18 is placed at the position shown in FIG. 4A. This causes pressure oil in valve stop oil pressure chamber 31 to be discharged through valve stop control line 45 and valve stop drain line 47 into oil pan 11. On the other hand, at the time of port cylinder operation, spool 18*a* is placed at the position shown in FIG. 4B thereby causing oil pressure of oil pump 10 to be supplied through second supply line 42 and valve stop control line 45 to valve stop oil pressure chamber 31.

In case oil pressure is supplied to valve stop mechanism 14 to start part cylinder operation at the time of advance, i.e., under the condition where pressure oil is discharged from retard side oil pressure chamber 27 into circulation line 48, pressure oil is supplied through circulation line 48 to valve stop oil pressure chamber 31 rapidly. Namely, in addition to pressure oil supplied from oil pump 10 to valve stop oil pressure chamber 31 by way of second supply line 42, control valve 18 and valve stop control line 45, pressure oil is supplied from retard side oil pressure chamber 27 to valve stop oil pressure chamber 31 by way of circulation line 48. Accordingly, retard side oil pressure chamber 27 functions as a kind of accumulator, so that it becomes possible to improve the responsiveness of valve stop mechanism 14 without using an additional accumulator or the like. As a result, it becomes possible to make longer the time of part cylinder operation and therefore it becomes possible to further improve the fuel consumption.

In other words, if the responsiveness of valve stop mechanism 14 is lowered, fuel will possibly be injected into a cylinder whose valves are stopped and therefore will possibly deteriorate the exhaust efficiency. However, since valve stop mechanism 14 starts part cylinder operation with an improved responsiveness, such a deterioration of the exhaust efficiency can be effectively suppressed.

Particularly, at low-speed engine operation, the oil pressure supplied by oil pump 10 is low so that the responsiveness of valve stop mechanism 14 tends to be lowered. However, according to the present invention, additional pressure oil is supplied from retard side oil pressure chamber 27 thereby enabling valve stop mechanism 14 to attain a good responsiveness even in an operation range where the oil pressure supplied to valve stop mechanism 14 is low.

Further, circulation line 48 is joined to valve stop control line 45 connecting between control valve 18 and valve stop oil pressure chamber 31 and is therefore constructed so as to supply pressure oil not through control valve 18 but directly to valve stop oil pressure chamber 31.

Figure 5A:
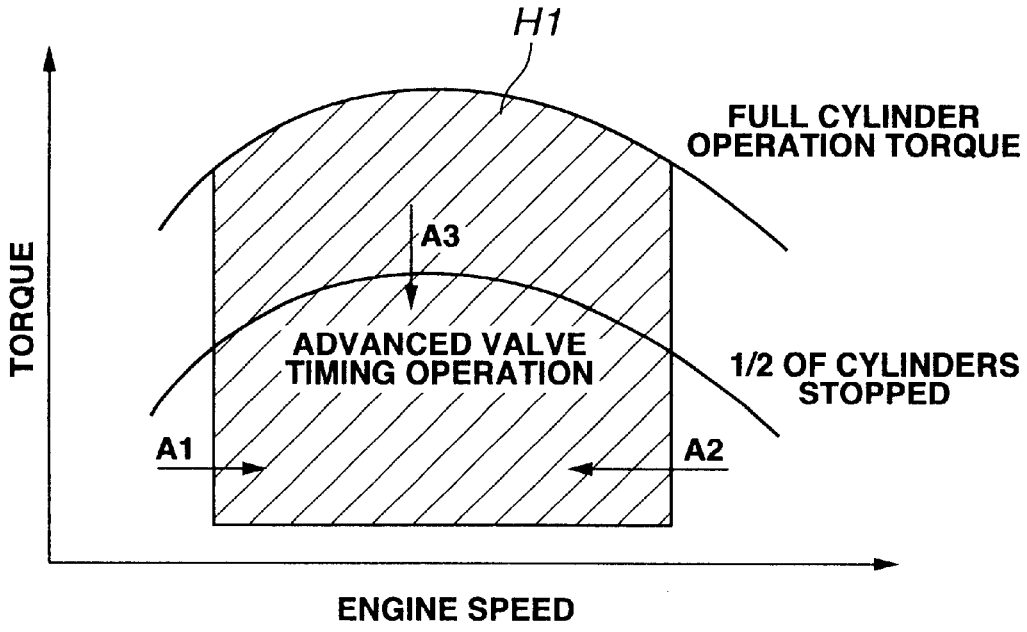
FIGS. 5A and 5B are graphs for showing an advanced valve timing operation range and a part cylinder operation range, respectively.
Figure 5B:
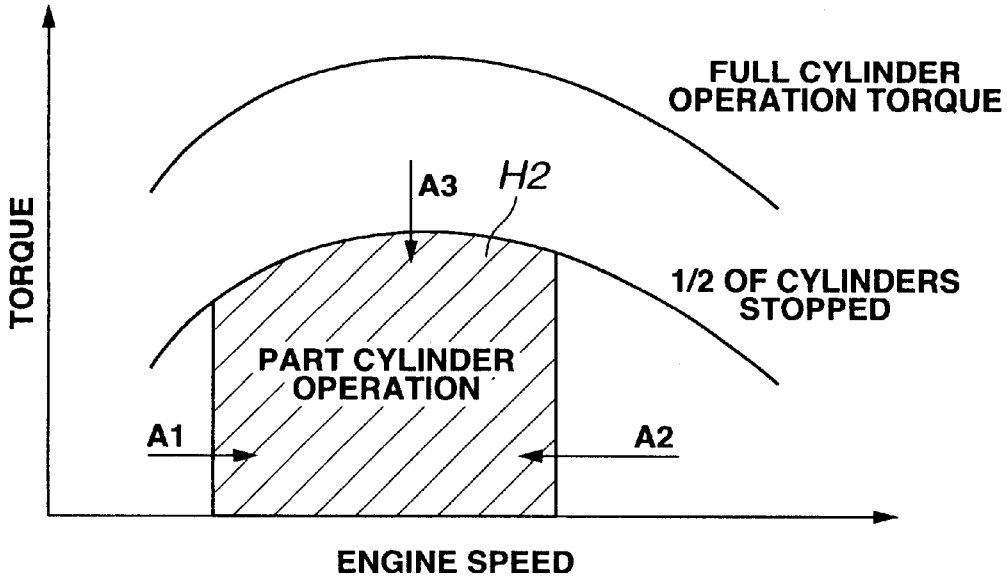

Further, as seen from FIGS. 5A and 5B, the region H2 where pressure oil is supplied to valve stop mechanism 14 to perform part cylinder operation with some of the cylinders kept out of operation is nearly included with the region H1 where the operation angle phase of the intake valve is advanced from the maximumly retarded phase by phase control mechanism 12 thereby performing an advanced timing engine operation. Namely, when part cylinder operation is performed, it is desirable to advance the operation angle phase of the intake valve thereby retaining a predetermined torque by means of the remaining cylinders, while increasing an internal EGR thereby improving the fuel consumption and reducing the NOx emission. Accordingly, when oil pressure is supplied to valve stop mechanism 14 to start part cylinder operation, it is highly possible that phase control mechanism 12 is in a state of operation where the operation angle phase is advanced.

As indicated by arrows A1 in FIGS. 5A and 5B, under an engine operating condition where the engine speed increases from the low-speed low-load range, the operating condition of phase control mechanism 12 is switched to the advance side simultaneously with switching to part cylinder operation. Further, as indicated by arrows A2, under an engine operating condition where the engine speed decreases from the high-speed low-load range, switching to the part cylinder operation is started during switching of phase control mechanism 12 to the advance side. Further, as indicated by arrows A3, even under an engine operating condition where the torque decreases from the high load range, switching to the part cylinder operation is started during switching of phase control mechanism 12 to the advance side. In this manner, when part cylinder operation is started, it is highly possible that phase control mechanism 12 has been switched to the advance side, i.e., it is highly possible that pressure oil is supplied through circulation line 48 to valve stop oil pressure chamber 31, so that it becomes possible to make effectively higher the responsiveness of the hydraulic control system at the time of start of part cylinder operation.

In the meantime, in case phase control mechanism 12 is switched to the advance side under a condition where the oil pressure downstream of check valve 49 is high so that check valve 49 cannot be opened, such as the case where part cylinder operation is performed continuously, control valve 51 is adapted to open to enable pressure oil in retard side oil pressure chamber 27 to be discharged through advance side drain line 50 to oil pan 11.

Further, at the time of full cylinder operation, the valve opening load of check valve 49 is lower than that of control valve (check valve) 51 and the oil pressure downstream of check valve 49 is low, so that when phase control mechanism 12 is switched to the advance side only check valve 49 is opened. Accordingly, pressure oil in retard side oil pressure chamber 27 is discharged through circulation line 48, valve stop control line 45 and valve stop drain line 47 to oil pan 11.

The entire contents of Japanese Patent Application P2001-12557 (filed Jan. 22, 2001) are incorporated herein by reference.

Although the invention has been described above by reference to a certain embodiment of the invention, the invention is not limited to the embodiment described above. Modifications and variations of the embodiment described above will occur to those skilled in the art, in light of the above teachings. For example, a flow restriction or orifice that generates a differential pressure can replace control valve 51. The scope of the invention is defined with reference to the following claims.

What is claimed is:

1. A hydraulic control system for an internal combustion engine comprising:

a first hydraulic operating mechanism;

a second hydraulic operating mechanism, wherein the first hydraulic operating mechanism and the second hydraulic operating mechanism are adapted to operate independently by oil pressure of a common oil pressure source; and a circulation line that supplies pressure oil discharged from the first hydraulic operating mechanism to the second hydraulic operating mechanism;

wherein the first hydraulic operating mechanism and the second hydraulic operating mechanism are valve control mechanisms adapted to vary lift characteristics of one of an intake valve and an exhaust valve.

2. A hydraulic control system according to claim 1, wherein the first hydraulic operating mechanism is a phase control mechanism for varying a phase of one of an intake valve and an exhaust valve.

3. A hydraulic control system according to claim 2, adapted so that the pressure oil discharged from the phase control mechanism when the phase of the intake valve is advanced by the phase control mechanism is supplied through the circulation line to the second hydraulic operating mechanism.

4. A hydraulic control system according to claim 1, wherein the second hydraulic operating mechanism is a valve stop mechanism for temporarily stopping intake and exhaust valves of some of cylinders when supplied with pressure oil.

5. A hydraulic control system according to claim 1, further comprising a check valve disposed in the circulation line adapted to prevent reverse flow of pressure oil from the second hydraulic operating mechanism to the first hydraulic operating mechanism.

6. A hydraulic control system according to claim 5, further comprising a drain line branching off from the circulation line at a location upstream of the check valve and a control valve disposed in the drain line, a valve opening load of the control valve being set at a value higher than that of the check valve.

7. A hydraulic control system according to claim 6, wherein the control valve is a check valve.

8. A hydraulic control system according to claim 5, further comprising a drain line branching off from the circulation line at a location upstream of the check valve and a flow restriction disposed in the drain line.

9. A hydraulic control system for an internal combustion engine comprising:

an oil pressure source;

an oil sump;

a first hydraulic operating mechanism;

a second hydraulic operating mechanism;

a first hydraulic control valve adapted to selectively communicate the first hydraulic operating mechanism with one of the oil pressure source and the oil sump thereby controlling an operation of the first hydraulic operating mechanism;

a second hydraulic control valve adapted to selectively communicate the second hydraulic operating mechanism with one of the oil pressure source and the oil sump thereby controlling an operation of the second hydraulic operating mechanism;

a control line fluidly connecting between the second hydraulic control valve and the second hydraulic operating mechanism adapted to conduct pressure oil supplied to and discharged from the second hydraulic operating mechanism; and a circulation line connecting between the first hydraulic control valve and the control line adapted to supply pressure oil discharged from the first hydraulic operating mechanism to the second hydraulic operating mechanism;

wherein the first hydraulic operating mechanism is a phase control valve adapted to vary a phase of one of an intake valve and an exhaust valve, and the second hydraulic operating mechanism is a valve stop mechanism adapted to temporarily stop intake and exhaust valves of some of cylinders.

10. A hydraulic control system according to claim 9, further comprising a check valve disposed in the circulation line adapted to prevent reverse flow of pressure oil from the second hydraulic operating mechanism to the first hydraulic operating mechanism.

11. A hydraulic control system according to claim 10, further comprising a drain line branching off from the circulation line at a location upstream of the check valve and a check valve disposed in the drain line, a valve opening load of the check valve disposed in the drain line being set at a value higher than that of the check valve disposed in the circulation line.

12. A hydraulic control system according to claim 10, further comprising a drain line branching off from the circulation line at a location upstream of the check valve and a flow restriction disposed in the drain line.

13. A hydraulic control system according to claim 9, wherein the oil pressure source comprises an oil pump driven by the engine.

14. A hydraulic control system for an internal combustion engine comprising:

a phase control mechanism for varying a phase of an intake valve;

a valve stop mechanism for temporarily stopping intake and exhaust valves of some of cylinders;

the phase control mechanism and the valve stop mechanism being operated independently by oil pressure of a common oil pressure source; and means for supplying pressure oil discharged from the phase control mechanism to the valve stop mechanism in addition to pressure oil supplied from the oil pressure source to the valve stop mechanism when the phase of the intake valve is advanced by the phase control mechanism and the intake and exhaust valves of some of the cylinders are stopped by the valve stop mechanism.

15. A hydraulic control system according to claim 14, wherein the means comprises a circulation line that fluidly connects between the phase control mechanism and the valve stop mechanism.

16. A hydraulic control system according to claim 15, further comprising a check valve disposed in the circulation line adapted to prevent reverse flow of pressure oil from the valve stop mechanism to the phase control valve.

17. A hydraulic control system according to claim 16, further comprising a drain line branching off from the circulation line at a location upstream of the check valve and a check valve disposed in the drain line, a valve opening load of the check valve disposed in the drain line being set at a value higher than that of the check valve disposed in the circulation line.

18. A hydraulic control system according to claim 16, further comprising a drain line branching off from the circulation line at a location upstream of the check valve and a flow restriction disposed in the drain line.

* * * * *